United States Patent [19]

Joseph et al.

[11] Patent Number: 4,961,733

[45] Date of Patent: Oct. 9, 1990

[54] FOOT CLEANING AND CHEMICAL APPLICATION APPARATUS

[75] Inventors: Peter M. Joseph; Thomas G. Michalek, both of Pittsburgh; Mylan Gruber, Monaca, all of Pa.

[73] Assignee: Dr. Joseph's Foot Products, Inc., Pittsburgh, Pa.

[21] Appl. No.: 214,447

[22] Filed: Jul. 1, 1988

[51] Int. Cl.[5] ..... A61M 35/00; A47K 7/04

[52] U.S. Cl. ..... 604/293; 15/114

[58] Field of Search ..... 604/293, 289; 15/114, 15/176.1, 176.6

[56] References Cited

U.S. PATENT DOCUMENTS 171,592 3/1954 Gore .
982,232 1/1911 Bartholomew .
2,303,660 12/1942 Schickel .
3,369,265 2/1968 Halberstadt et al. ..... 15/176.1
3,508,547 4/1970 Deuschle ..... 604/1
3,531,814 10/1970 Safalow .
4,181,446 1/1980 Kaufman ..... 115/114
4,543,679 10/1985 Rosofky et al. .

FOREIGN PATENT DOCUMENTS 0234061 9/1987 European Pat. Off. ..... 604/1
1201581 of 1958 France .

*Primary Examiner*—Stephen C. Pellegrino
*Attorney, Agent, or Firm*—Webb, Burden, Ziesenheim & Webb

[57] ABSTRACT

A cleaning and chemical applicator element, attached to a handle, for cleaning and application of chemicals between the toes of a person's foot.

5 Claims, 1 Drawing Sheet

FOOT CLEANING AND CHEMICAL APPLICATION APPARATUS

BACKGROUND OF THE INVENTION

1. Field of the Invention

This invention is directed to apparatus which aids in the cleaning of and application of chemicals to a person's feet and, more specifically, to a cleaning and chemical application apparatus which is sized and shaped to be received between the toes of the person's feet.

2. Description of the Prior Art

Personal hygiene is an important factor in the maintenance of a person's health. One particular area of a person's body which requires particular attention, with respect to cleanliness, is a person's feet. A variety of skin diseases can afflict the skin of a person's feet resulting in undesirable and possibly dangerous infections.

One way to minimize the possibility of such infections is to clean the feet periodically to prevent microorganisms, which cause such infections, from multiplying. However, persons who have difficulty in bending over, frequently, cannot reach their feet to periodically clean them. This is especially true with persons who are overweight, elderly or have arthritis. The present invention provides apparatus which assists such persons, as well as persons who do not have a problem in bending over, with proper personal hygiene of their feet.

A variety of devices have been proposed as cleaning devices. None provide the advantages of the claimed invention.

U.S. Letters Pat. No. 982,232 discloses a medicinal applicator and swab for applying medicine to various cavities of the body and head of a person.

U.S. Letters Pat. No. 2,303,660 discloses a general utility brush which could be useful in kitchens, bathrooms, offices, laundries and dairies.

U.S. Letters Pat. No. 3,531,814 discloses a toe cleaning device which includes a detachable, conical or bell-shaped toe cleaning member which is attached to a rod. One-half of the conical, bell-shaped cleaning member is a bristle brush while the remaining half is made of sponge.

U.S. Letters Pat. No. 4,543,679 discloses a toothbrush assembly which includes a handle with a replaceable brush assembly and a replaceable oral hygiene device. This patent is directed, primarily, to the promotion of hygiene of a person's mouth.

U.S. Design Pat. No. 171,592 discloses a chemical applicator which employs a handle member. The handle member includes a bristle brush, which is attached at one end, and an absorbent applicator which is attached at the other end.

SUMMARY OF THE INVENTION

Apparatus is provided for personal hygiene which includes a handle and cleaning apparatus which is releaseably secured to the handle and adapted to be received between the toes of a foot of a person for cleansing the foot of the person.

Also provided is apparatus for cleaning a foot of the person which includes a generally elongated handle with one end of the handle adapted to be held by a hand of the person and the other end releaseably securing absorbent material with the absorbent material sized and shaped to be received between the toes of the person.

Additionally provided is apparatus for applying chemicals to a foot of a person comprising handle apparatus and chemical applicator apparatus releaseably secured to the handle apparatus and adapted to be received between the toes of a foot for applying chemicals to the foot of the person.

BRIEF DESCRIPTION OF THE DRAWINGS

The following detailed description of the preferred embodiment may be better understood if reference is made to the accompanying drawings in which.

DETAILED DESCRIPTION OF THE PREFERRED EMBODIMENT

Figure 1:
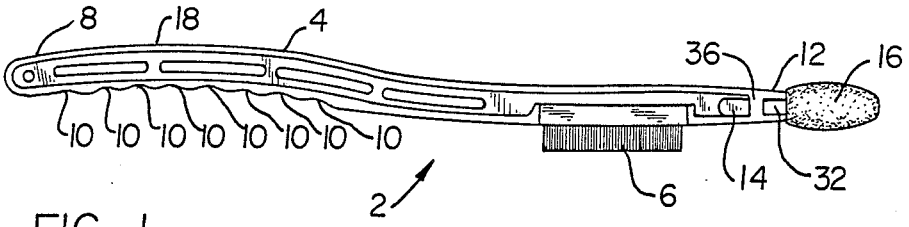
FIG. 1 is a front elevational view of the present invention.
Figure 2:
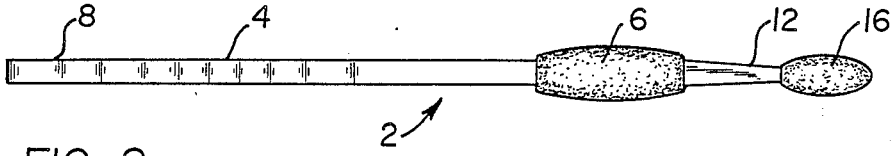
FIG. 2 is a side elevational view of the apparatus of FIG. 1.
Figure 3:
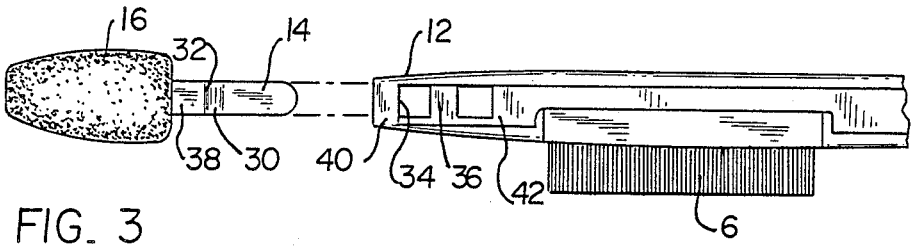
FIG. 3 is an exploded view of a portion of the apparatus of FIG. 1.
Figure 4:
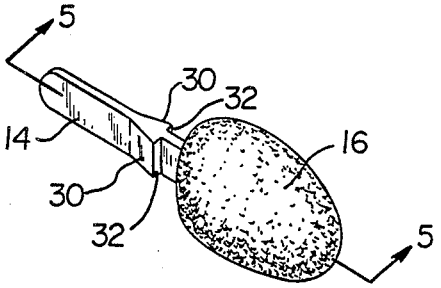
FIG. 4 is a perspective view of the cleaning and chemical application element and connector of FIG. 1.

FIGS. 1 through 5 show the preferred embodiment of the present invention. Cleaning and chemical applicator apparatus 2 includes handle 4 which is adapted to be held by a person. Cleaning and chemical applicator apparatus 2 includes, preferrably, brush 6, which may be either molded into or glued onto handle 4. Brush 6 is, preferably, constructed of nylon bristles which are mold resistant. End 8, of handle 4, includes a plurality of indentations 10 which allow handle 4 to be easily held by a hand of a person.

Handle 4 is preferably, made of polypropylene, because of its mold resistance characteristics, although other materials, such as wood, metal and other plastics, would function effectively also. Handle 4 is, preferably, the same length as the distance between a typical person's knee and foot.

End 12, of handle 4, is adapted to receive connector 14, which supports absorbent material 16. Absorbent material 16 is sized and shaped to fit easily between the toes of a person who is using cleaning, and chemical applicator apparatus 2. Absorbent material 16 is, preferably, a natural or synthetic sponge type material, although a non-sponge absorbent material, such as cloth, would be equally acceptable.

It is contemplated that absorbent material 16 could be made available in a variety of surface abrasive or hardness levels, depending on the particular application. For example, a soft material would be available for general cleaning while a more abrasive material would be available for removing dry surface skin. Handle 4 includes curved surface 18 which allows absorbent material 16 to meet the foot of the person at a convenient angle.

Figure 5:
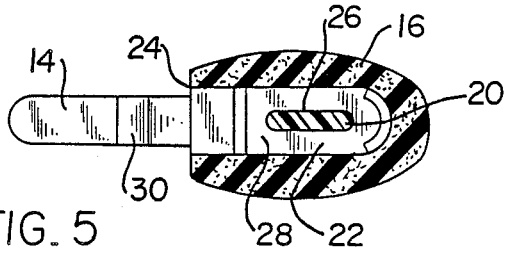
FIG. 5 is a sectional view of the cleaning and chemical application element and connector of FIG. 1.

FIG. 5 shows a detail of how absorbent material 16 is attached to connector 14. Connector 14 defines opening 20. Connector portion 22 fits within opening 24 of absorbent material 16. Opening 20 allows absorbent material portion 26 to come into contact with an identical portion of absorbent material 16 (not shown) which is positioned on side 28 of connector 14. Absorbant material portion 26 may then be glued directly to the other portion of absorbent material 16, which is adjacent side 28, thereby securing absorbent material 16 to connector 14. This method of securing absorbent material 16 to connector 14 provides two advantages.

First, many glues which bond well to absorbent material 16 do not bond effectively to the polypropylene, which is the material, preferably, from which connector 14 is formed. Second, when it is desired to replace sponge 16 with a new sponge, portions of the old sponge may continue to adhere to connector 14 and be difficult to remove if a glue is employed which does bond well to polypropylene. Both of these problems are eliminated when the two adjacent portions of sponge 16 are glued together through opening 20 and not directly to connector 14.

Connector 14 includes locks 30 with edges 32. The end of the handle 4 has an opening formed by a pair of spaced members, namely end portions 40 and 42, in a first plane extending the length of handle 4 and a bar member 36 in a second plane parallel to and laterally displaced from the first plane. When connector 14 is inserted into the opening in end 12 of handle 4, one edge 32 snaps behind surface 34 on the inner edge of end portion 40. Connector 14 is positioned with surface 38 behind bar 36 and the opposite surface 38 (not shown) in contact with end portions 40 and 42.

It may be appreciated, therefore, that the convenient length of handle 4, and the size and shape of absorbent material 16 provides a convenient device to ensure good personal hygiene of a person's feet.

While the above description of cleaning and chemical applicator apparatus 2 has been presented in conjunction with the cleaning of a person's feet, it is to be understood that apparatus 2 may also be employed to apply chemicals, such as medication, between the toes and over the surfaces of the person's feet. In such a case absorbent material 16 would be moistened with the appropriate chemical and then applied to requisite areas of one or both feet. Apparatus 2 is especially useful in applying such chemicals between the toes of the person.

Whereas particular embodiments of the invention have been described above for purposes of illustration, it will be evident to those persons skilled in the art that numerous variations of the details may be made without departing from the invention as defined in the appended claims.

What is claimed is:

1. Apparatus for cleaning or applying chemicals to a foot of a person comprising:

a generally elongated handle having two ends and having a length approximately equal to the distance between the person's knee and foot;

one end of the handle being adapted to be held by a hand of the person;

an opposite end of the handle including means for releasably securing hereto a connector means carrying an absorbent material of a size and shape to be received between the toes of the person;

said securing means including a pair of spaced members in a first plane extending the length of the handle and a member in a second plane parallel to and laterally displaced from said first plane to provide an opening between the members in the respective planes; and said connector means having two ends, one end adapted to be inserted into said opening with opposed surfaces of said end frictionally engaging said members and locking means on the opposed surfaces of said end for engaging at least one of said spaced members to secure the connector to the handle, the absorbent material being attached to an opposite end of said connector means.

2. The apparatus of claim 1 wherein said connector means includes an opening through said opposed surfaces through which a portion of said absorbent material is positioned for connection to an opposite portion or said absorbent material to retain the absorbent material on the connector means.

3. The apparatus of claim 1 wherein said handle includes a brush positioned intermediate the ends of the handle.

4. The apparatus of claim 1 wherein said handle is curved at the end to be held by the hand of the person and includes a plurality of indentation which allow the handle to be easily held.

5. The apparatus of claim 1 wherein said absorbent material comprises applicator means for applying chemicals to the foot of the person.

* * * * *

UNITED STATES PATENT AND TRADEMARK OFFICE

CERTIFICATE OF CORRECTION

PATENT NO. : 4,961,733

DATED : October 9, 1990

INVENTOR(S) : Peter M. Joseph, Thomas G. Michalek and Mylan Gruber

It is certified that error appears in the above-identified patent and that said Letters Patent is hereby corrected as shown below:

Claim 1 Line 12 Column 4 "hereto" should read --thereto--.

Claim 2 Line 33 Column 4 "or" should read --of--.

Claim 4 Line 40 Column 4 "indentation" should read --indentations--.

Signed and Sealed this

Seventh Day of January, 1992

*Attest:*

HARRY F. MANBECK, JR.

*Attesting Officer*

*Commissioner of Patents and Trademarks*